US011708702B1

(12) United States Patent
Mjelde

(10) Patent No.: US 11,708,702 B1
(45) **Date of Patent: *Jul. 25, 2023**

(54) AUTOMATIC POOL CLEANER

(71) Applicant: AquaStar Pool Products, Inc., Ventura, CA (US)

(72) Inventor: Olaf Mjelde, Ventura, CA (US)

(73) Assignee: AQUASTAR POOL PRODUCTS, INC., Ventura, CA (US)

( * ) Notice: Subject to any disclaimer, the term of this patent is extended or adjusted under 35 U.S.C. 154(b) by 211 days.

This patent is subject to a terminal disclaimer.

(21) Appl. No.: 17/393,085

(22) Filed: Aug. 3, 2021

Related U.S. Application Data

(63) Continuation of application No. 16/929,478, filed on Jul. 15, 2020, now Pat. No. 11,149,458.

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
USPC ..... 15/1.7
See application file for complete search history.

(56) References Cited

U.S. PATENT DOCUMENTS

| | | | | |
|---|---|---|---|---|
| 4,275,474 | A * | 6/1981 | Woodard | E04H 4/1636 15/421 |
| 4,536,908 | A * | 8/1985 | Raubenheimer | E04H 4/1654 180/8.1 |
| 5,172,445 | A | 12/1992 | Chandler | |
| 5,285,547 | A | 2/1994 | Sebor | |
| 5,351,709 | A | 10/1994 | Vos | |
| 5,904,171 | A | 5/1999 | Stahle et al. | |
| 6,112,354 | A | 9/2000 | Stoltz et al. | |
| 6,314,983 | B1 | 11/2001 | Hatch | |
| 7,284,565 | B2 | 10/2007 | Sebor | |
| 9,127,472 | B2 | 9/2015 | Borg et al. | |
| 2004/0040581 | A1 | 3/2004 | Bruwer | |

* cited by examiner

*Primary Examiner* — Thomas Raymond Rodgers
(74) *Attorney, Agent, or Firm* — Cislo & Thomas, LLP

(57) ABSTRACT

An automatic pool cleaner comprising a housing and a base. The housing comprises a suction flow pathway, an impeller disposed within the housing and in fluid communication with the suction flow pathway such that water traveling through the suction flow pathway spins the impeller, an off-center cam that extends through the impeller and is configured to rotate as the impeller rotates, and two spring biased valves. Each valve comprises a valve seat, and a spring biased poppet configured to seal against the valve seat, the poppet having a rod with a spring disposed around the rod. The base comprises two feet, each foot having a spring-biased pad extending from each end of the foot, two A-arm assemblies, one for each foot, and a suction port that extends through the base.

19 Claims, 10 Drawing Sheets

AUTOMATIC POOL CLEANER

CROSS-REFERENCE TO RELATED APPLICATIONS

This application is a continuation of U.S. Non-Provisional patent application Ser. No. 16/929,478, filed Jul. 15, 2020, titled "Automatic Pool Cleaner," the contents of which are incorporated by reference herein in their entirety.

BACKGROUND

The care and cleaning of swimming pools and spas occupies a great deal of time for owners and operators. It has long been recognized that an automatic pool cleaner that will automatically traverse the pool bottom surface while effectively picking up dirt and debris is desired. It has also been recognized that an automatic pool cleaner that uses the existing pool water recirculation equipment, does not use electricity in its internal operation, and is of low cost, is desired.

Accordingly, there is a need for an improved pool cleaner.

SUMMARY

In the invention described herein is directed to an automatic pool cleaner. In a first embodiment, the automatic pool cleaner has a housing and a base.

The housing comprises a suction flow pathway that extends through the housing, an impeller, a vacuum line connection port, and two spring biased valves.

The impeller is disposed within the housing and in fluid communication with the suction flow pathway such that water traveling through the suction flow pathway spins the impeller, wherein spinning of the impeller causes the pool cleaner to move forward.

The vacuum line connection port extends vertically through the housing.

The two spring biased valves are disposed within the housing. Each valve comprises a valve seat, and a spring biased poppet configured to seal against the valve seat, the poppet having a rod with a spring disposed around the rod.

The base has two feet, one on either side of the base, and a suction port that extends through the base and is in fluid communication with the vacuum line connection port.

Ideally, the housing has two side surfaces, a front surface and a back surface, and further comprises a removable cover.

Ideally, the housing includes an off-center cam that extends through the impeller and is configured to rotate as the impeller rotates.

Ideally, each foot has opposed ends and a spring-biased pad extends from each end of each foot.

Ideally, each pad is rotatably coupled to a respective foot by a housing and there is a spring coupled to each housing that is configured to bias the corresponding housing away from an interior surface of the foot.

Ideally, the base further comprises two A-arm assemblies, one for each foot. Each A-arm assembly comprises an axle for rotatably coupling the corresponding foot to the base, and two rotatable wheels rotatably coupled to the A-arm assembly. The wheels are configured to rest on either side of the off-center cam, whereby rotation of the off-center cam causes the corresponding A-arm assembly to rock back and forth.

Ideally, each foot has an opening having two flat sides and an end of the axle of the A-arm assembly has two flat surfaces configured to mate with the two flat sides of the opening.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION

Figure 1:
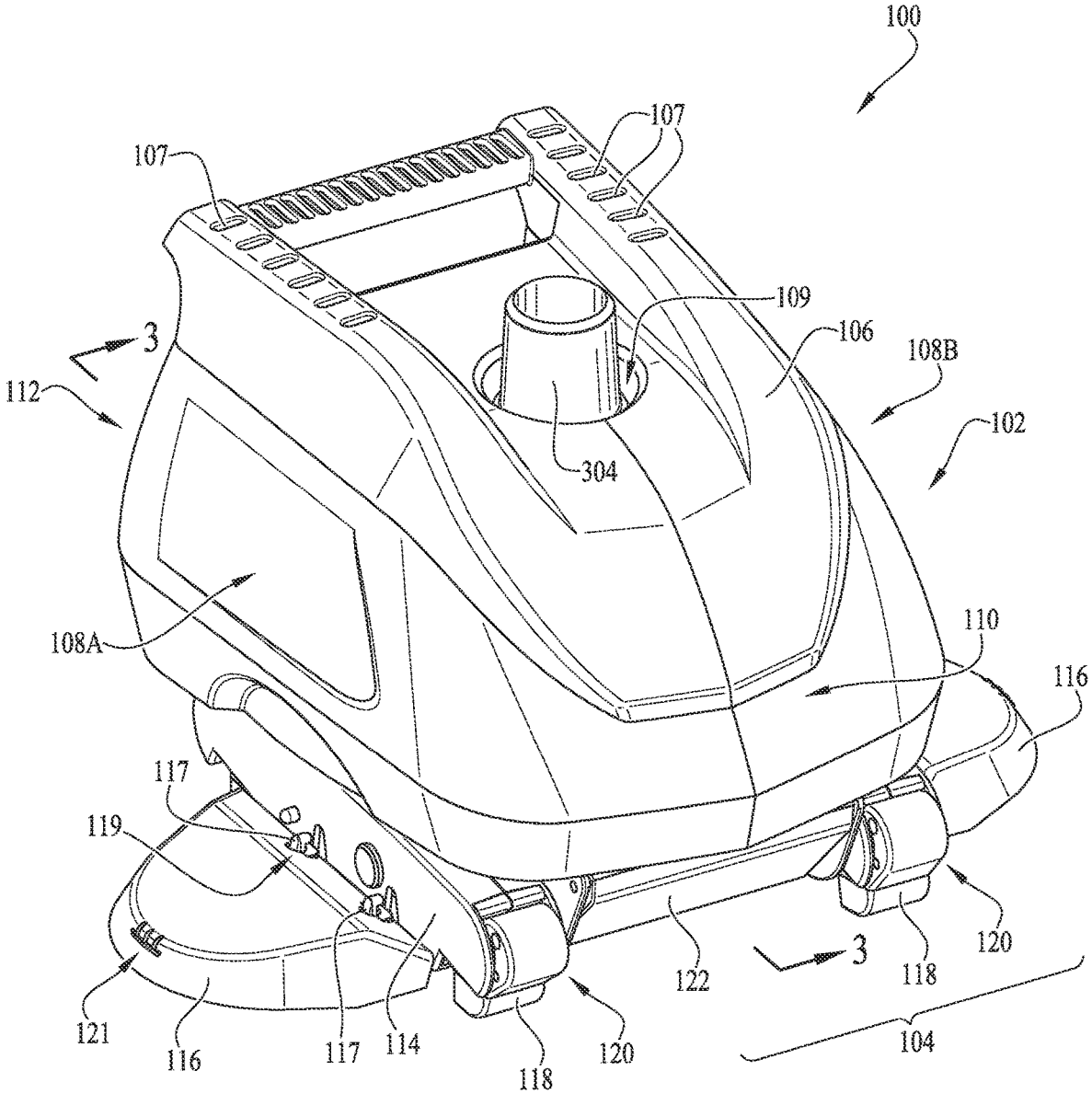
FIG. 1 is a top perspective view of my automatic pool cleaner.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

Referring now to the drawings, wherein like reference numerals designate identical or corresponding features throughout the several views. Further, described herein are certain non-limiting embodiments of my pipeline filter assembly for pool filtering and maintenance.

Figure 2:
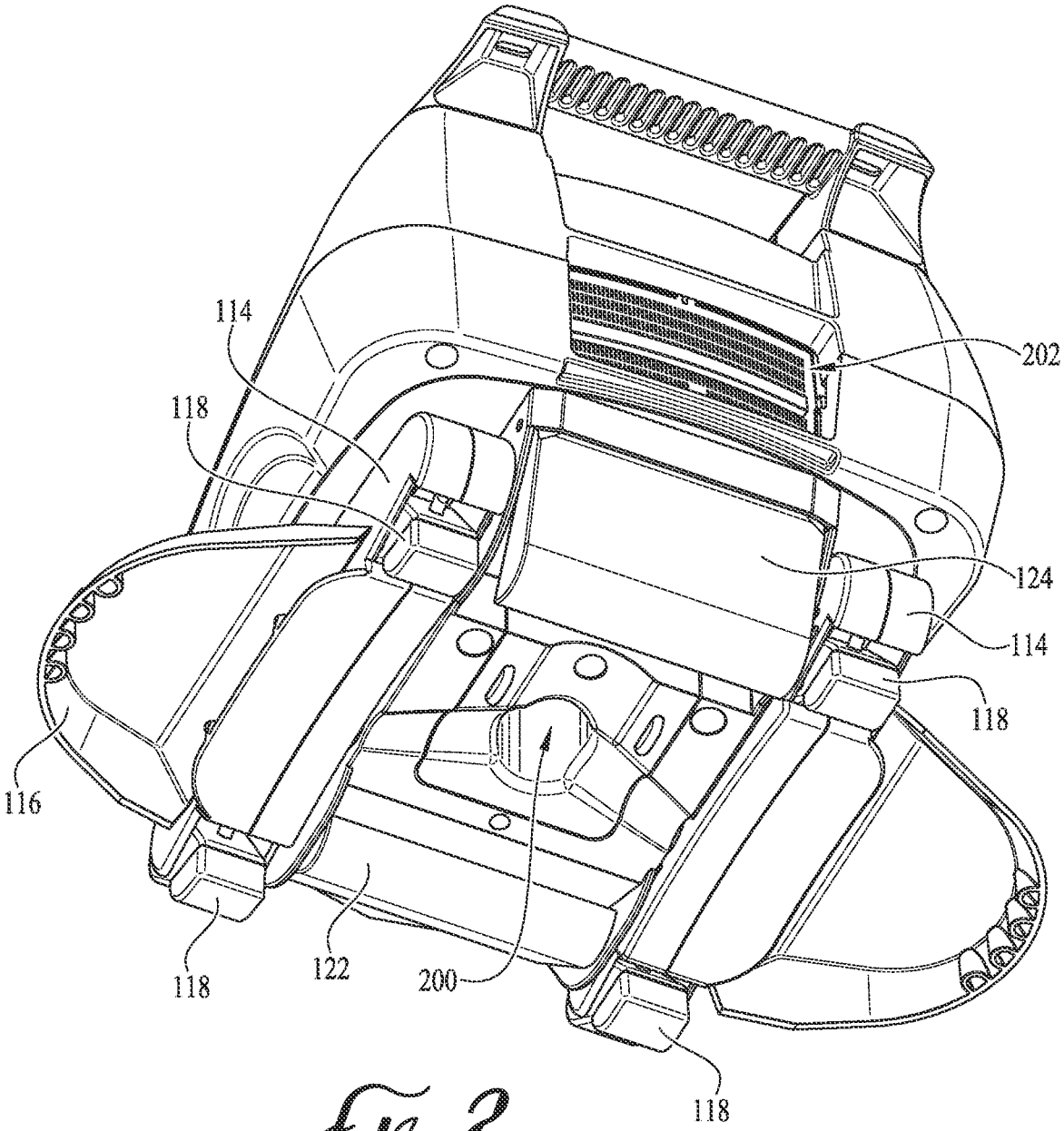
FIG. 2 is a bottom perspective view of my pool cleaner of FIG. 1.

Referring to FIGS. 1 and 2, there is shown my automatic pool cleaner 100. The pool cleaner comprises a housing 102 and a base 104. The base 104 has two feet 114, two paddles 116 and a suction port 200.

The housing 102 has a removable top cover 106, two side surfaces 108A, 108B, a front surface 110, and a back surface 112. The cover 106 has a plurality of openings 107 configured to let pool water pass into and out of the housing 102. The cover 106 also has a center opening 109. On the back surface 112 of the housing 102 is a bypass suction inlet 202.

Figure 3:
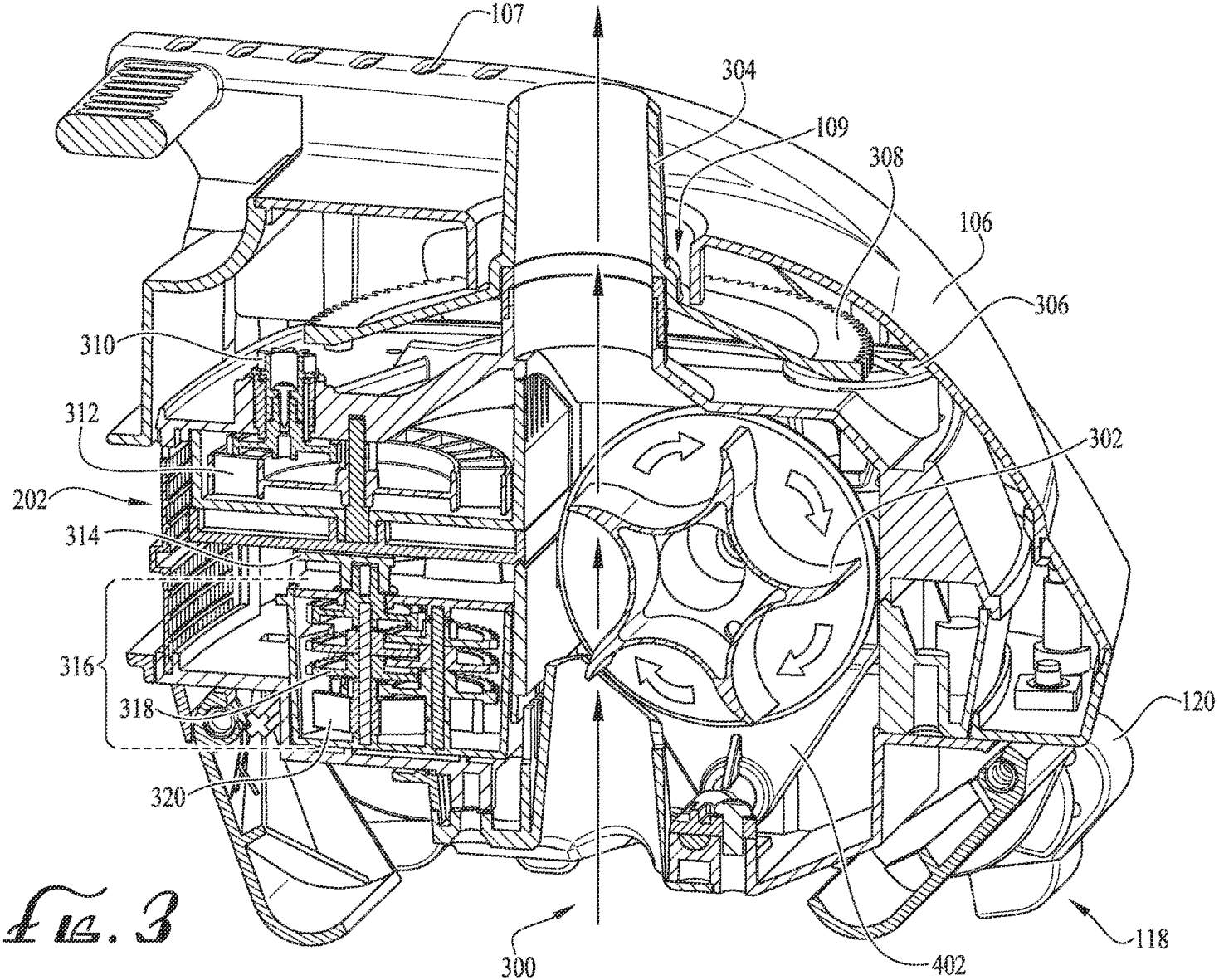
FIG. 3 is sectional view of my pool cleaner of FIG. 1, taken along line 3-3—, wherein the flow of water is shown.
Figure 4:
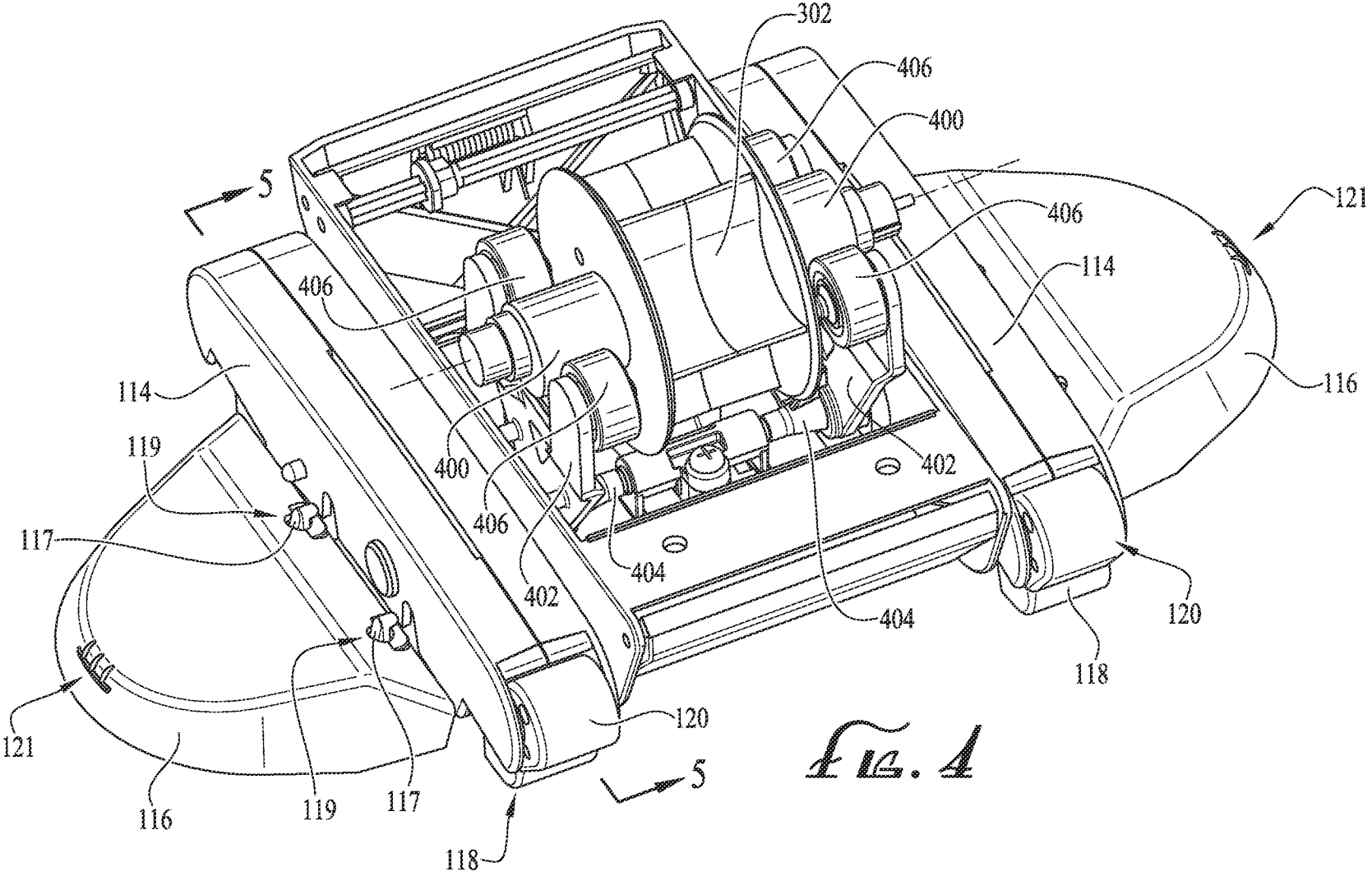
FIG. 4 is a top perspective view of a lower portion of my pool cleaner of FIG. 1.

As best seen in FIGS. 3 and 4, the housing 102 also has a suction flow pathway 300 that extends through the housing 102, an impeller 302, and a vacuum line connection port 304, an off-center cam 400, and two spring biased valves 306.

The impeller 302 is rotatably disposed within the housing 102 and is in fluid communication with the suction flow pathway 300 such that water traveling through the suction flow pathway 300 spins the impeller 302. When the impeller 302 spins, it causes the pool cleaner 100 to move forward via movement of the feet 114, which is discussed in greater detail below.

The vacuum line connection port 304 is coupled to one end of the suction flow pathway 300 and extends vertically through the center opening 109 in the removable cover 106. The vacuum line connection portion 304 is configured to removably couple to a vacuum source. Typically, the vacuum source is the existing filter system for the pool.

There is a gear 308 around the base of the vacuum line connection port 304. Rotation of the vacuum line port gear 308 causes the vacuum line connection port 304 to rotate. Gear 308 has a plurality of teeth that rotatably engage with a plurality of teeth on a connection gear 310. Connection gear 310 is rotatably disposed within the housing 102 in close proximity to the vacuum line port gear 308. The connection gear 310 is rotatably coupled to a turbine 312. Rotatably positioned below the turbine 312 is a blocking disc 314 and below the blocking disc 314 is a gear box 316. The blocking disc 314 is coupled to the gear box 316 via a shaft. The blocking disc 314 rotates at slow speed (via the gear box 316) to alternate flow of water through the turbine 312. The alternating flow causes the turbine 312 to alternate spinning clockwise and counter-clockwise.

The turbine 312 rotates due to flow of water through the bypass inlet port 202, which is regulated by the rotation of the blocking disc 314. Rotation of the turbine 312 causes the connection gear 310 to rotate, which causes the vacuum line connection port gear 308 to rotate, ultimately causing the vacuum line connection port 304 to rotate. As noted above, turbine 312 alternates between spinning clockwise and counter-clockwise. This means that the vacuum line connection port gear 308 (and connection port 304) also alternate between rotating clockwise and counter-clockwise. This change in rotation direction causes the cleaner 100 to also change direction, ensuring that the cleaner 100 covers all areas of the pool floor.

The gear box 316 contains a plurality of stacked gears 318 and a gear box impeller 320. The gears 318 are rotated by the flow of water through the bypass suction inlet 202, causing the gear box impeller 320 to rotate. The gearbox is a 6-stage gear box and it serves two purposes: reduce the gear box impeller 320 speed and cause the blocking disc 314 to rotate at a slow speed.

As shown in FIG. 4, the off-center cam 400 extends through the impeller 302. Rotation of the impeller 302 (via water passing through the suction flow pathway 300) causes the cam 400 to also rotate. Rotation of the cam 400 is discussed in greater detail below.

As best seen in FIGS. 11-14, the two spring biased valves 306 are disposed within the housing 102. Each valve comprises a valve seat 1200, and a spring biased poppet 1202 configured to seal against the valve seat 1200. The poppet 1202 has a mushroom-shaped end piece 1204 coupled to an axial rod 1206. The rod 1206 has a spring 1208 encircling the rod 1206 and providing a biasing pressure between a lower surface of the end piece 1204 and a base of the valve 306. The function of the valves 306 is discussed in greater detail below.

Figure 5:
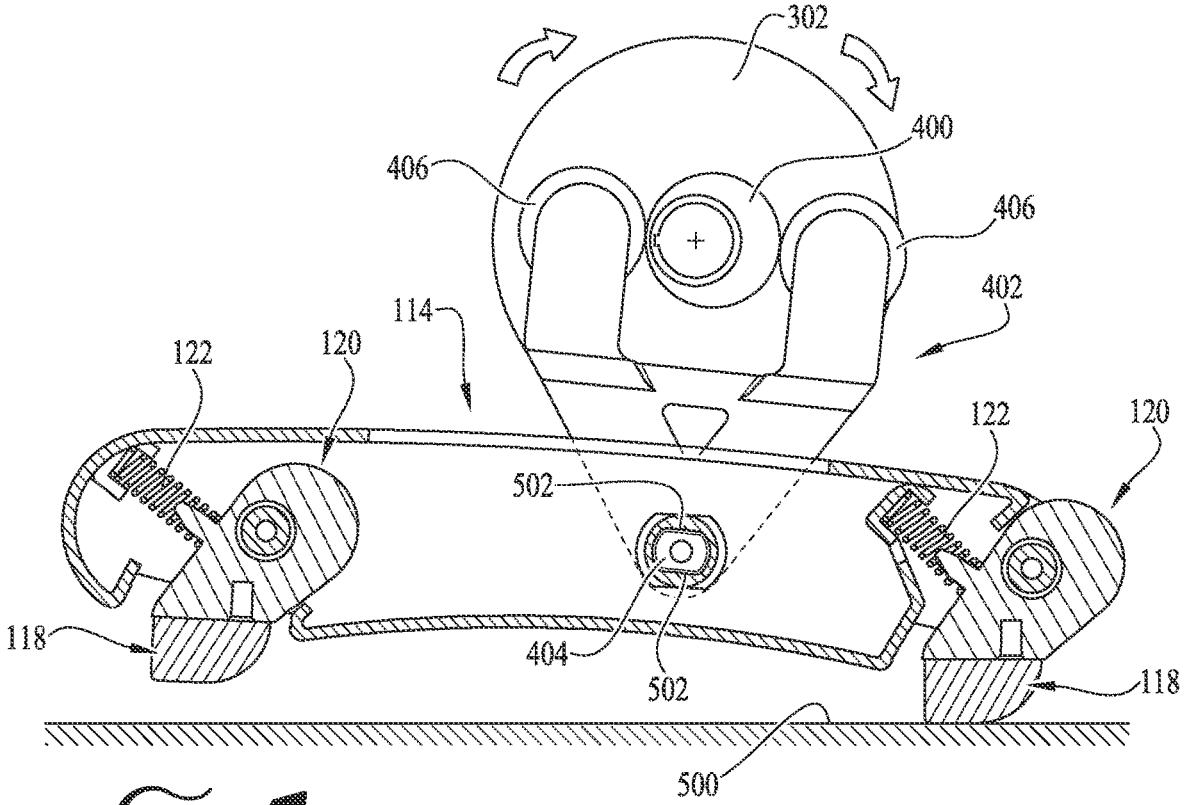
FIG. 5 is a sectional view of the lower portion of my pool cleaner of FIG. 4, taken along line 5-5, wherein rotation of an impeller and feet of the cleaner can be seen.
Figure 6:
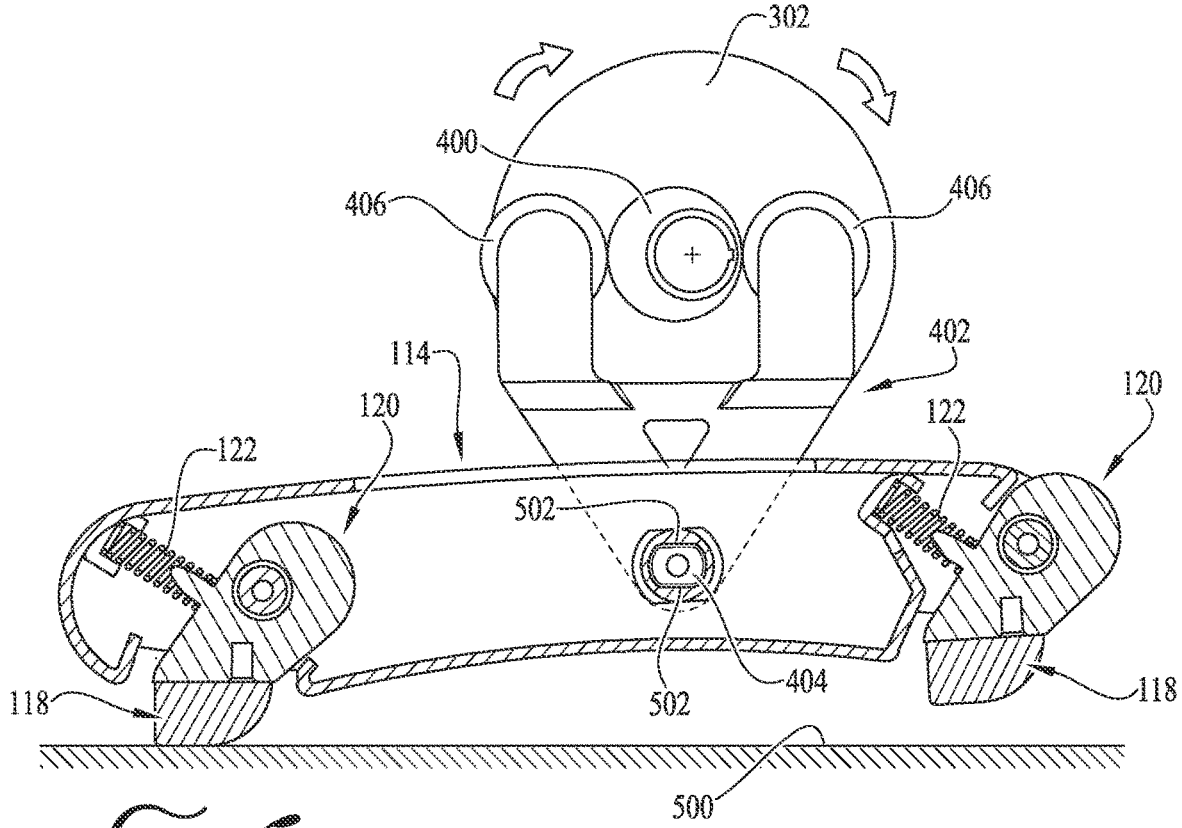
FIG. 6 is a sectional view of the lower portion of my pool cleaner of FIG. 4, taken along line 5-5, wherein rotation of the impeller and feet can be seen.
Figure 7:
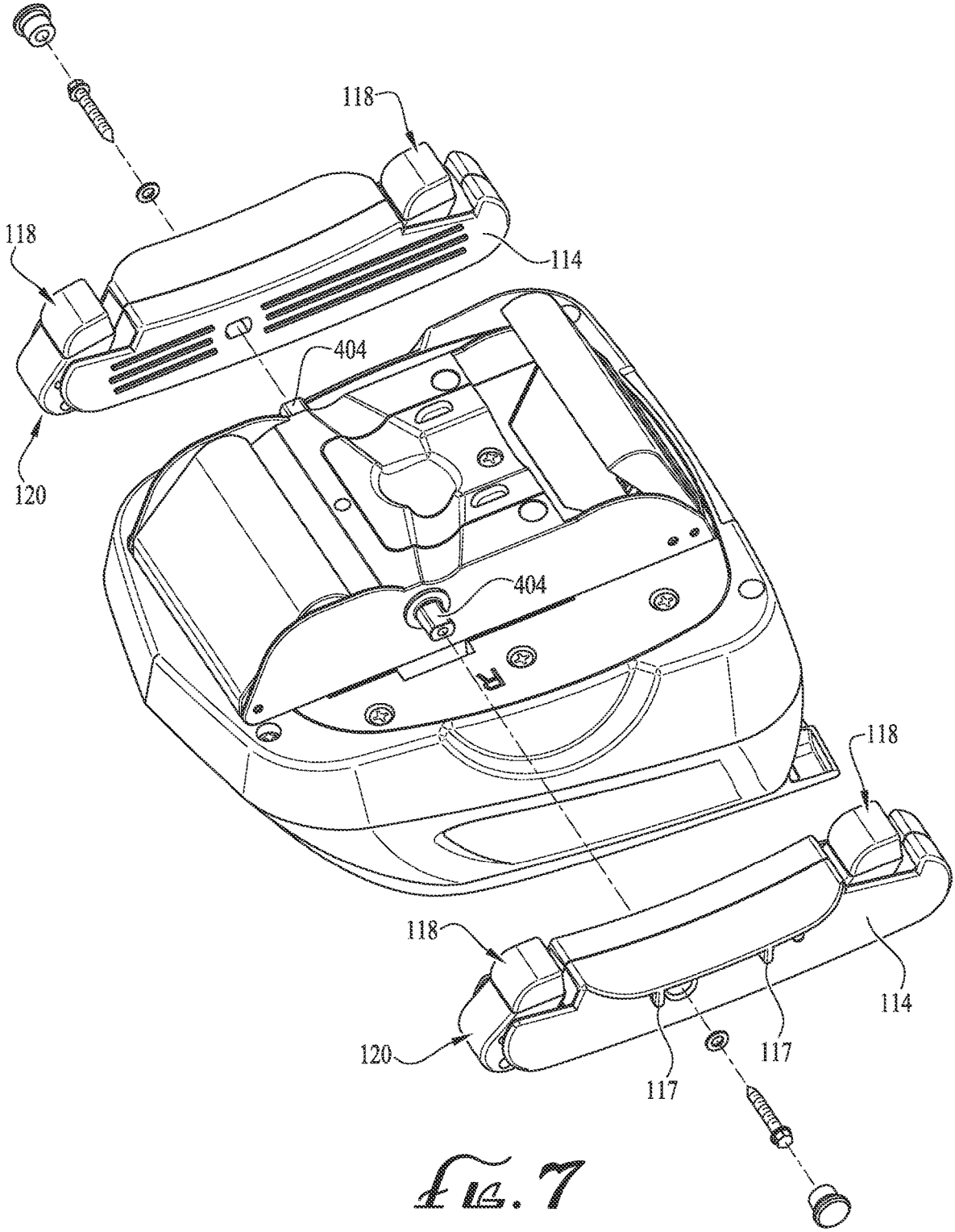
FIG. 7 is an exploded bottom perspective view of the lower portion of my pool cleaner of FIG. 4.
Figure 8:
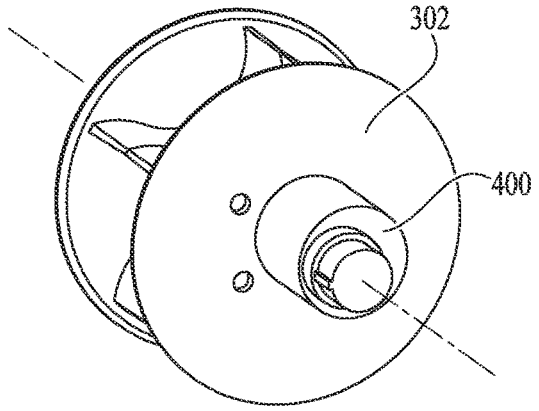
FIG. 8 is a perspective view of the impeller of the lower portion of my pool cleaner of FIG. 4.
Figure 9:
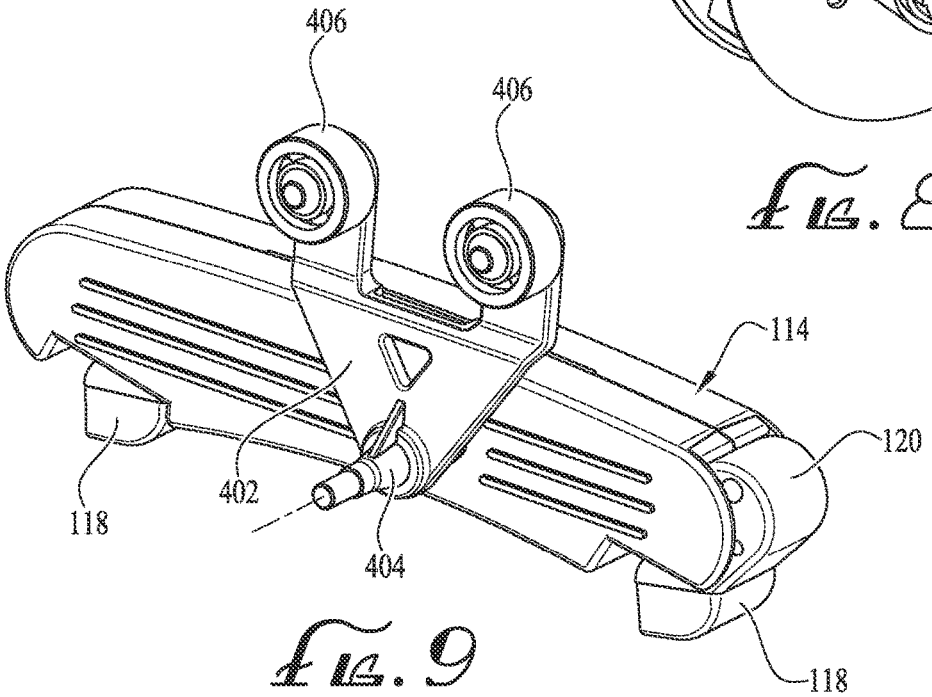
FIG. 9 is a perspective view of an A-arm assembly and corresponding foot of the lower portion of my pool cleaner of FIG. 4.
Figure 10:
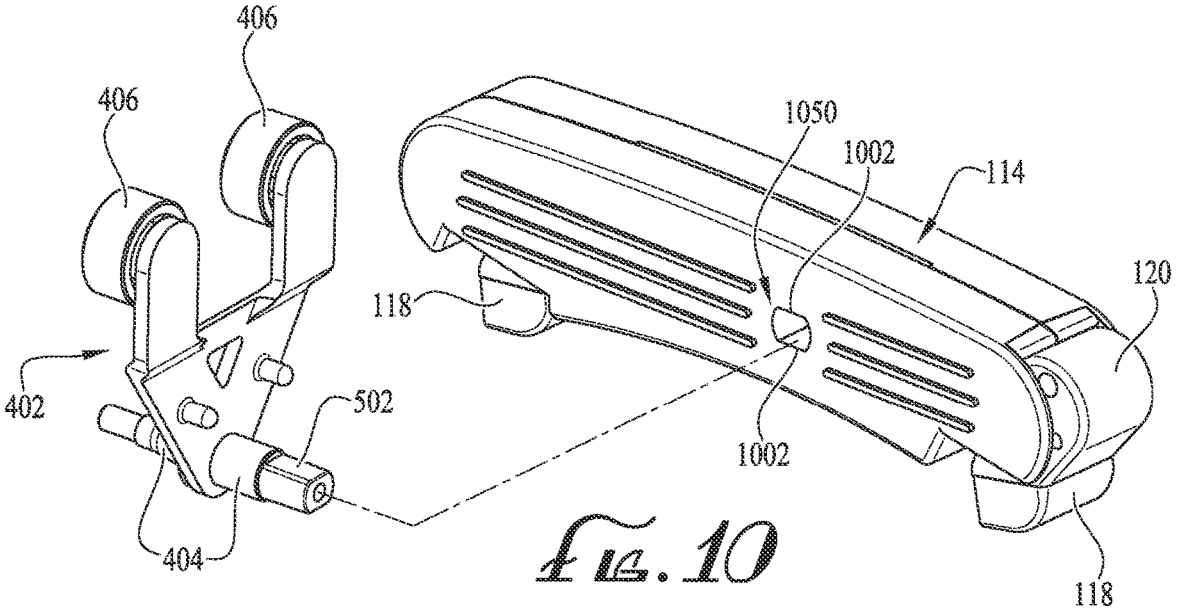
FIG. 10 is an exploded view of the A-arm assembly and corresponding foot of FIG. 9, wherein the A-arm assembly has been removed from the foot.
Figure 11:
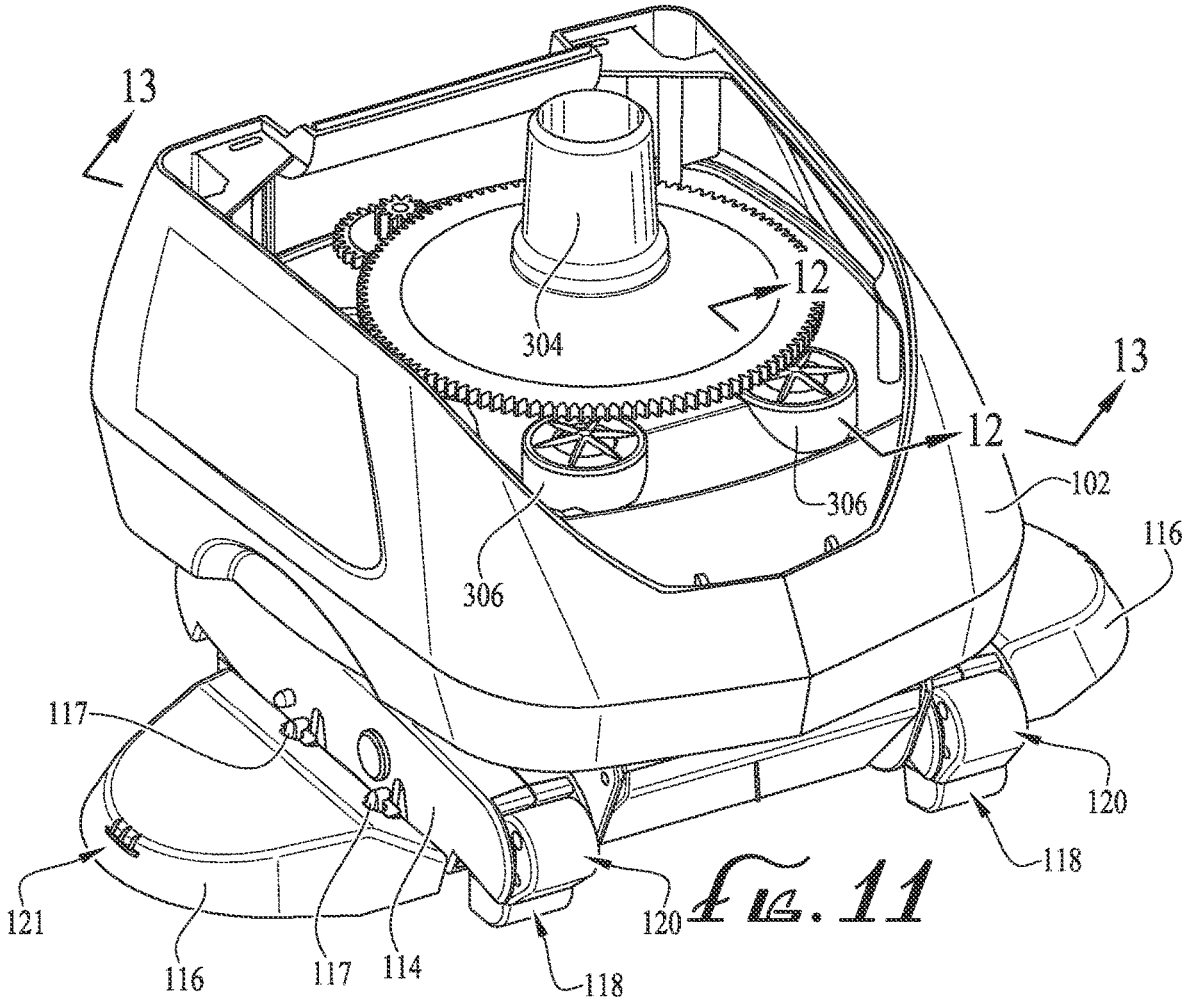
FIG. 11 is a top perspective view of my pool cleaner of FIG. 1, wherein the top portion of the housing has been removed.
Figure 12:
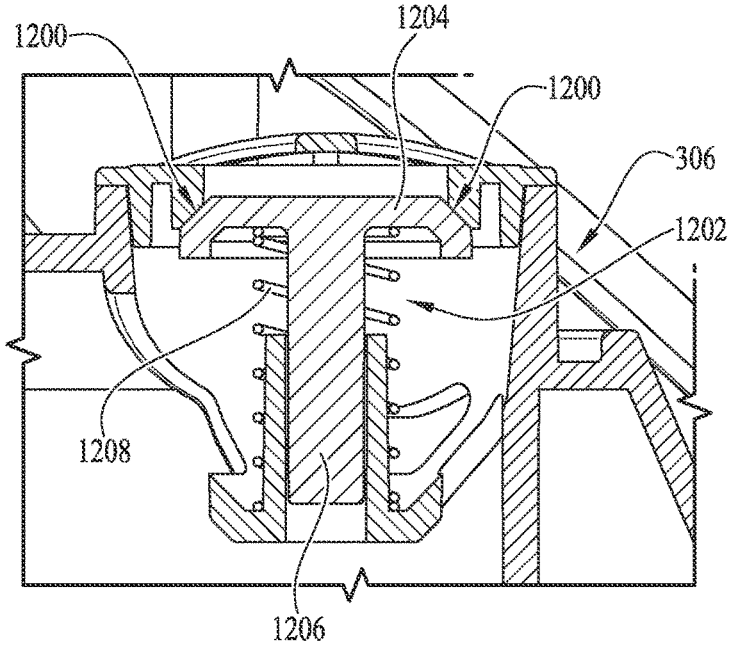
FIG. 12 is an enlarged sectional view of a portion of my pool cleaner of FIG. 11, taken along line 12-12.

The two feet 114 are disposed on either side of the base 104. Each foot 114 has an elongated, slightly arched shape with opposed ends. A spring-biased pad 118 extends from each end of each foot 114. As best seen in FIGS. 5 and 6, each pad 118 is rotatably coupled to its respective foot 114 via a housing 120. There is a spring 122 coupled to each housing 120 and configured to bias the corresponding housing 120 away from an interior surface of the foot 114. This bias keeps the pad 118 in contact with a pool surface as the pool cleaner 100 moves.

The pads 118 have wear indicators on their sides. The wear indicator is a line on the side of the pad 118 that appears as a difference in texture. When this texture difference is no longer visible at the bottom of the pad 118 when viewed from either side, the pads 118 must be changed.

As best seen in FIGS. 4-6 and 9-10, each foot 114 is coupled to the cleaner 100 by an A-arm assembly 402. Each A-arm assembly 402 comprises an axle 404 for rotatably coupling the corresponding foot 114 to the base 102. Each A-arm assembly 402 also comprises two rotatable wheels 406 rotatably coupled to the A-arm assembly 402 that are configured to rest on either side of the off-center cam 400. This can be seen in FIGS. 5 and 6. Rotation of the off-center cam 400 causes the corresponding A-arm assembly 402 to rock back and forth. Due to the cam 400 being off-center, the foot 114 connected to the A-arm assembly 402 also rocks, alternating between lifting the front pad 118 off the pool surface 500, while the rear pad 118 remains in contact with the pool surface 500, and lifting the read pad 118 off the pool surface 500 while the front pad 118 remains in contact with the pool surface 500. This alternating lifting motion is what moves the pool cleaner 100 along the pool surface 500.

Preferably, each foot 114 has an opening 1000 for insertion of the axel 404 therein. More preferably, the opening 1000 has two flat sides 1002 and an end of the axle 404 configured to mate with the foot 114 has two flat surfaces 502, such that the two flat sides 1002 of the opening 1000 mates securely mates with the two flat surfaces 502 of the axel 404. This configuration is desirable because the flat sides 1002/flat surfaces 502 help the axel 404 and the corresponding foot 114 endure the stress repeated lifting and placing to move the cleaner 100 forward.

The base 104 also comprises two paddles 116, one paddle 116 connected to each foot 114. Each foot 116 has a pair of hooks 117 that are configured for insertion through a corresponding pair of openings 119 in each paddle 116. The openings 119 in the paddle 116 are slipped over the hooks 117 and the paddle 116 is pivoted/bent downward, away from the sidewalls 108A, 108B of the cleaner, and locked into place. To remove the paddles 116, the paddles 116 are bent upwards towards the sidewalls 108A, 108B of the cleaner 100. This allows the paddles 116 to be lifted off the hooks 117. Each paddle 116 has a wear indicator 121 which is a horizontal line with three vertical lines above it. The paddles 116 must be replaced when the horizontal line can no longer be seen. The paddles 116 are hollow underneath, creating a cavity. This cavity helps extend the suction flow/cleaning area under the cleaner 100. Each paddle 116 is hinged to its respective foot 114 so that the paddles 116 can conform to uneven pool surfaces.

The suction port 200 is an opening that extends through the base 104 and is in fluid communication with the suction flow pathway 300 and the vacuum line connection port 304. Pool water is sucked through the suction port 200, into the suction flow pathway 300 where it spins the impeller 302, and after spinning the impeller 302, the pool water exits the cleaner 100 through the vacuum line connection port 304.

The cleaner 100 also has a front flap 122 and a rear flap 124 coupled to the base 104. The front and rear flaps 122, 124 are hinged to the cleaner 100 and create a seal of sorts that directs the suction flow of water perpendicular to the direction of travel of the cleaner 100.

Referring now to FIGS. 11-14, the function of the impeller 302 and the valves 306 will now be discussed in greater detail. As noted above, pool water is sucked into the cleaner 100 through the suction port 200. Once inside the cleaner 100, the pool water is now inside the suction flow pathway 300. Flow of the water through the suction flow pathway 300 causes the impeller 302 to spin. As the impeller 302 spins, the feet 114 are caused to rock back and forth, moving the cleaner 100 along the pool surface 500. One issue that often arises in automatic pool cleaners 100 is regulation of the vacuum pressure within the cleaner 100. Because the cleaner 100 is hooked up to the existing pool filter system, regulation of the pressure can be difficult, and there can be significant fluctuations which will cause the cleaner 100 to move too fast and put undue stress on the components of the cleaner 100. In order to prevent these pressure fluctuations from damaging the cleaner 100, valves 306 are provided.

As noted above, there is at least one valve 306, but preferably, there are two or more valves 306. Each valve 306 has a valve seat 1200, and a spring biased poppet 1202 configured to seal against the valve seat 1200. The rod 1206 of the poppet 1202 has a spring 1208 that encircles it and provides a biasing pressure between a lower surface of the end piece 1204 and a base of the valve 306.

Figure 13:
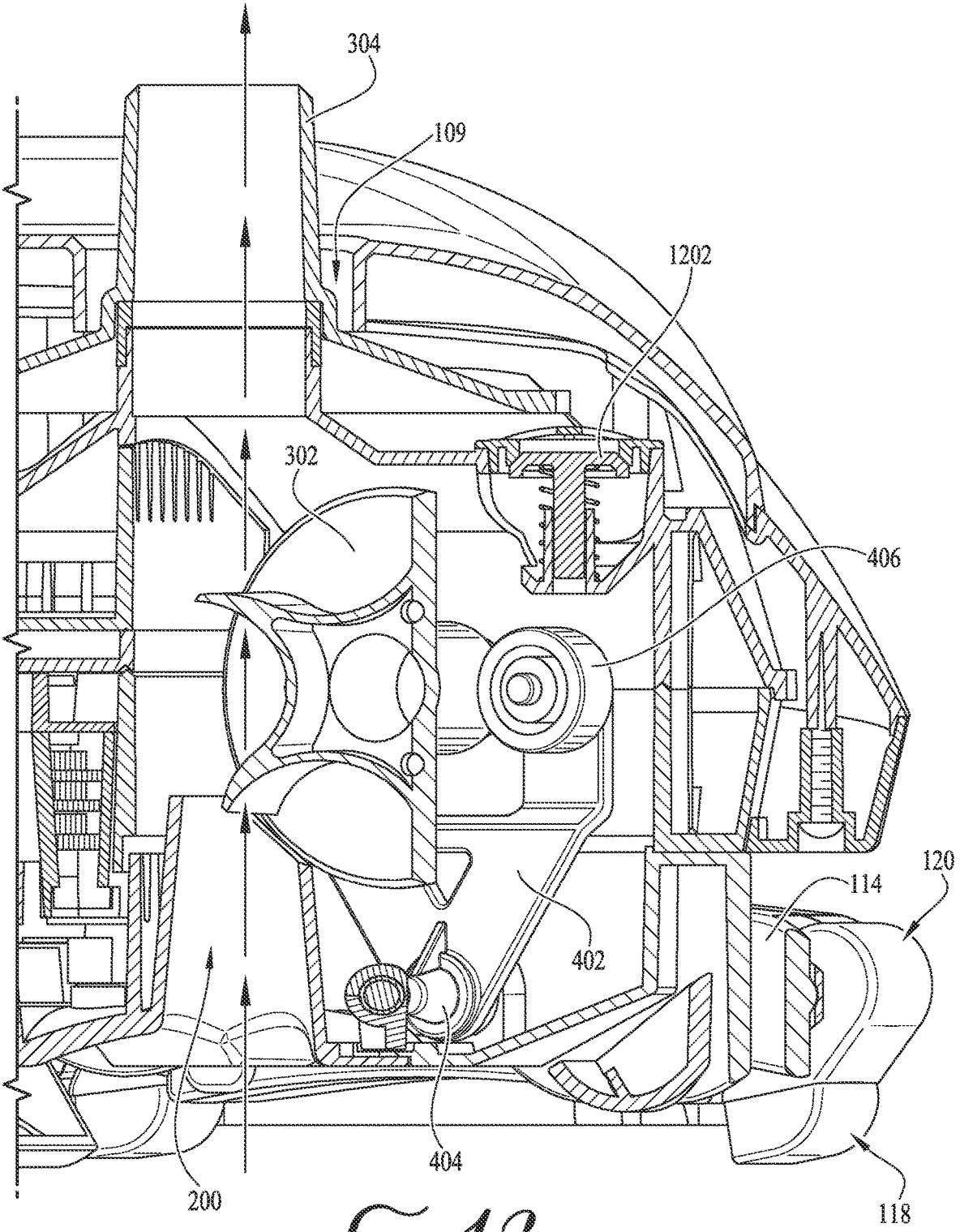
FIG. 13 is a sectional view of my pool cleaner of FIG. 11, taken along line 13-13, wherein normal water flow is shown.

Under normal operating vacuum pressure, shown in FIG. 13, the pool water flows through the suction port 200, into the suction flow pathway 300 spinning the impeller 302, and out through the vacuum line connection port 304. The valve 306 remains closed, where the poppet 1202 is sealed against the valve seat 1200. The normal operating vacuum pressure is not enough to override the biasing pressure of the spring 1208.

Figure 14:
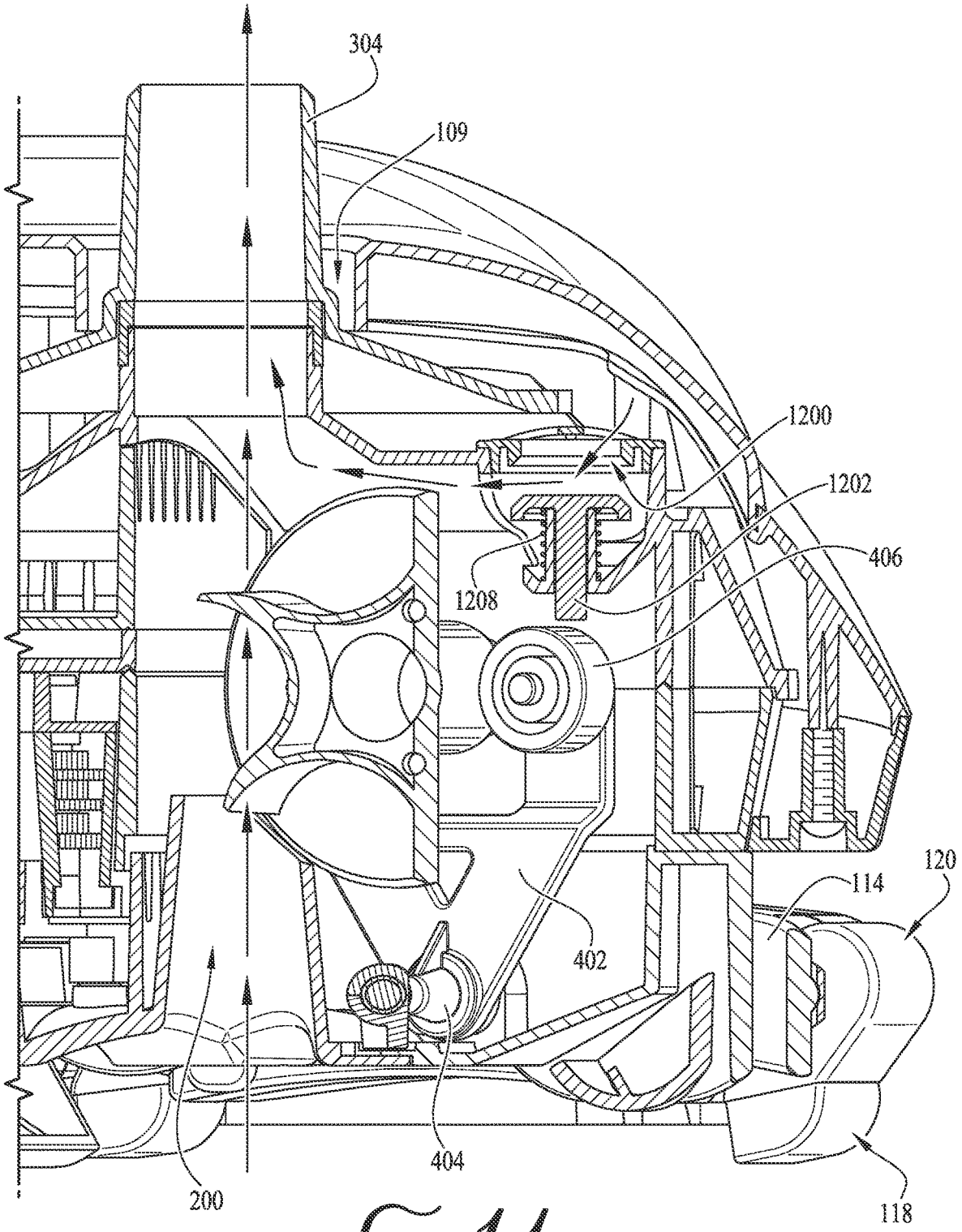
FIG. 14 is a sectional view of my pool cleaner of FIG. 11, taken along line 14-14, wherein diverted water flow is shown.

FIG. 14 shows the flow path of the pool water when the vacuum pressure is not optimal. In this instance, the vacuum pressure is strong enough to override the biasing pressure of the spring 1208. This causes the poppet 1202 to be pulled down and un-sealed from the valve seat 1200. Additional pool water can now enter the cleaner 100 through the valves 306. This allows the cleaner 100 to continue running/moving at its optimal speed, regardless of pressure fluctuations that are caused by the pool filter system. These valves 306 also prevent unnecessary wear and tear on the cleaner 100 due to those pressure fluctuations. An additional advantage of these valves 306 is that they are incorporated into the cleaner 100 itself and require no extra installation or work on the part of the pool owner. Moreover, the valves 306 do not require any sort of electricity or computer system to run. They are purely mechanical, which is ideal as the cleaner 100 is constantly immersed in water. Along the same lines, the mechanical nature of the valves 306 makes them simple, with less pieces to break and wear out. The valves 306 are a simple and elegant solution to the pressure fluctuation problem.

While particular forms of the invention have been illustrated and described, it will also be apparent to those skilled in the art that various modifications can be made without departing from the spirit and scope of the invention.

Although the present invention has been described in considerable detail with reference to certain preferred embodiments, other embodiments are possible. The forgoing description is not intended to be exhaustive or to limit the invention to the precise form disclosed. Many modifications and variations are possible in light of the above teaching. The steps disclosed for the present embodiments, for example, are not intended to be limiting nor are they intended to indicate that each step is necessarily essential to the embodiment, but instead are exemplary steps only. Therefore, the scope of the appended claims should not be limited to the description of preferred embodiments contained in this disclosure. All references cited herein are incorporated by reference. Insofar as the description above and the accompanying drawings disclose any additional subject matter that is not within the scope of the claims below, the inventions are not dedicated to the public and the right to file one or more applications to claim such additional inventions is reserved.

What is claimed is:

1. An automatic pool cleaner comprising:

a) a housing comprising:

i) a suction flow pathway that extends through the housing;

ii) an impeller disposed within the housing and in fluid communication with the suction flow pathway such that water traveling through the suction flow pathway spins the impeller;

iii) an off-center cam that extends through the impeller and is configured to rotate as the impeller rotates; and iv) two automatic spring biased valve assemblies, each valve assembly comprising:

1) a valve assembly housing disposed within the pool cleaner housing, the valve assembly housing having an open top and a bottom, the bottom having a hollow, cylindrical projection that projects into an interior of the valve assembly housing;

2) a valve seat coupled to the open top of the valve assembly housing; and 3) a spring biased poppet disposed within the valve assembly housing and configured to seal upwards against the valve seat, the poppet having a rod that is disposed within the cylindrical projection of the valve assembly housing, wherein a spring is disposed around the rod and the cylindrical projection; and b) a base comprising:

i) two feet, each foot having opposed ends and a spring-biased pad extending from each end of the foot;

ii) two A-arm assemblies, one for each foot, each A-arm assembly comprising:

1) an axle for rotatably coupling the corresponding foot to the base; and 2) two rotatable wheels rotatably coupled to the A-arm assembly and configured to rest on either side of the off-center cam, whereby rotation of the off-center cam causes the corresponding A-arm assembly to rock back and forth.

2. The cleaner of claim 1, wherein each foot has an opening having two flat sides and an end of the axle of the A-arm assembly has two flat surfaces configured to mate with the two flat sides of the opening.

3. The cleaner of claim 1, wherein the two automatic spring biased valves automatically open and close in response to vacuum pressure changes.

4. An automatic pool cleaner comprising:

a) a housing comprising:

i) a suction flow pathway that extends through the housing;

ii) an impeller disposed within the housing and in fluid communication with the suction flow pathway such that water traveling through the suction flow pathway spins the impeller; and iii) two automatic spring biased valve assemblies, each valve assembly comprising:

1) a valve assembly housing disposed within the pool cleaner housing, the valve assembly housing having an open top and a bottom, the bottom having a hollow, cylindrical projection that projects into an interior of the valve assembly housing;

2) a valve seat coupled to the open top of the valve assembly housing; and 3) a spring biased poppet disposed within the valve assembly housing and configured to seal against the valve seat, the poppet having a rod that is disposed within the cylindrical projection of the valve assembly housing, wherein a spring is disposed around the rod and the cylindrical projection iv) wherein the impeller is configured to spin and cause the pool cleaner to move forward via movement of at least one foot.

5. The cleaner of claim 4, further comprising an off-center cam that extends through the impeller and is configured to rotate as the impeller rotates.

6. The cleaner of claim 4, further comprising a base having: a) the at least one foot comprising, wherein the at least one foot comprises two feet, one on either side of the base; b) two A-arm assemblies, one for each foot; and c) a suction port that extends through the base and is in fluid communication with the vacuum line connection port.

7. The cleaner of claim 6, wherein each foot has opposed ends, and a spring-biased pad extends from each end of each foot.

8. The cleaner of claim 6, wherein each pad is rotatably coupled to a respective foot by a foot housing and there is a spring coupled to each foot housing that is configured to bias the corresponding foot housing away from an interior surface of the foot.

9. The cleaner of claim 6, wherein each A-arm assembly comprises:

a) an axle for rotatably coupling the corresponding foot to the base; and b) two rotatable wheels rotatably coupled to the A-arm assembly and configured to rest on either side of the off-center cam, whereby rotation of the off-center cam causes the corresponding A-arm assembly to rock back and forth.

10. The cleaner of claim 9, wherein each foot has an opening having two flat sides and an end of the axle of the A-arm assembly has two flat surfaces configured to mate with the two flat sides of the opening.

11. The cleaner of claim 4, wherein the two automatic spring biased valves automatically open and close in response to vacuum pressure changes.

12. An automatic pool cleaner comprising:

a) a housing comprising:

i) a suction flow pathway that extends through the housing;

ii) an impeller disposed within the housing and in fluid communication with the suction flow pathway such that water traveling through the suction flow pathway spins the impeller; and iii) two automatic spring biased valve assemblies, each valve assembly comprising:

1) a valve assembly housing disposed within the pool cleaner housing, the valve assembly housing having an open top and a bottom, the bottom having a hollow, cylindrical projection that projects into an interior of the valve assembly housing;

2) a valve seat coupled to the top of the valve assembly housing; and 3) a spring biased poppet disposed within the valve assembly housing and configured to seal against the valve seat, the poppet having a rod that is disposed within the cylindrical projection of the valve assembly housing, wherein a spring is disposed around the rod and the cylindrical projection iv) wherein the impeller is configured to spin and cause the pool cleaner to move forward via movement of two feet, one on either side of the base.

13. The cleaner of claim 12, wherein the housing further comprises a removable cover.

14. The cleaner of claim 12, further comprising an off-center cam that extends through the impeller and is configured to rotate as the impeller rotates.

15. The cleaner of claim 12, wherein each foot has a spring-biased pad extending from each end of the foot.

16. The cleaner of claim 15, wherein each pad is rotatably coupled to a respective foot by a foot housing and there is a spring coupled to each foot housing that is configured to bias the corresponding foot housing away from an interior surface of the foot.

17. The cleaner of claim 12, further comprising two A-arm assemblies, one for each foot, wherein each A-arm assembly comprises:

a) an axle for rotatably coupling the corresponding foot to the base; and b) two rotatable wheels rotatably coupled to the A-arm assembly and configured to rest on either side of the off-center cam, whereby rotation of the off-center cam causes the corresponding A-arm assembly to rock back and forth.

18. The cleaner of claim 17, wherein each foot has an opening having two flat sides and an end of the axle of the A-arm assembly has two flat surfaces configured to mate with the two flat sides of the opening.

19. The cleaner of claim 12, wherein the two automatic spring biased valves automatically open and close in response to vacuum pressure changes.

* * * * *